US007163196B2

(12) United States Patent
Behr et al.

(10) Patent No.: US 7,163,196 B2
(45) Date of Patent: Jan. 16, 2007

(54) COMPACT CARPET STRETCHER

(75) Inventors: Jerome P. Behr, Northfield, MN (US); Timothy L. Behr, Mounds View, MN (US); David P. Behr, Crystal, MN (US)

(73) Assignee: Behr Innovations LLC, Northfield, MN (US)

( * ) Notice: Subject to any disclaimer, the term of this patent is extended or adjusted under 35 U.S.C. 154(b) by 0 days.

(21) Appl. No.: 10/958,982

(22) Filed: Oct. 5, 2004

(65) Prior Publication Data

US 2006/0060830 A1 Mar. 23, 2006

(51) Int. Cl.
*B25B 25/00* (2006.01)
*B65H 77/00* (2006.01)

(52) U.S. Cl. ..... 254/209; 254/212; 294/8.6

(58) Field of Classification Search ..... 254/200, 254/205, 209–212; 294/8.6
See application file for complete search history.

(56) References Cited

U.S. PATENT DOCUMENTS

| | | | | | |
|---|---|---|---|---|---|
| 292,693 | A * | 1/1884 | Shaffer | 254/212 |
| 317,296 | A * | 5/1885 | Carter | 254/209 |
| 377,309 | A * | 1/1888 | Kiendardt | 254/205 |
| 388,864 | A * | 9/1888 | Hall | 254/212 |
| 448,992 | A * | 3/1891 | Pool | 254/209 |
| 551,411 | A * | 12/1895 | Snell | 254/210 |
| 639,718 | A * | 12/1899 | Dexer | 254/212 |
| 843,743 | A * | 2/1907 | Giddings et al. | 254/200 |
| 910,595 | A * | 1/1909 | Smith | 254/209 |
| 4,076,213 | A | 2/1978 | Payson | |
| 4,934,658 | A | 6/1990 | Berg et al. | |
| 5,007,616 | A | 4/1991 | Scarpino | |
| 5,183,238 | A * | 2/1993 | Sorensen | 254/209 |
| 5,269,576 | A | 12/1993 | Krebs et al. | |
| 5,288,057 | A * | 2/1994 | Listau | 254/212 |
| 5,664,764 | A * | 9/1997 | Ruppricht | 254/209 |
| 5,681,031 | A | 10/1997 | Foley | |
| 5,782,458 | A * | 7/1998 | Prinzi et al. | 254/209 |
| 5,938,182 | A | 8/1999 | Goodrich et al. | |
| 6,073,328 | A | 6/2000 | Hendricks | |
| 6,405,999 | B1 * | 6/2002 | Curran | 254/200 |
| 6,491,284 | B1 * | 12/2002 | Jolly et al. | 254/209 |
| 6,669,174 | B1 | 12/2003 | Vita | |
| 6,692,048 | B1 | 2/2004 | Martin | |
| 2001/0030252 | A1 * | 10/2001 | Yamaguchi | 242/245 |

OTHER PUBLICATIONS

"No. 477, Easy Stretch—Makes carpet stretching faster and easier without tubing," [online]. Beno J. Gundlach Company, [retrieved on Sep. 10, 2004]. Retrieved from the Internet: <URL: www.benojgundlachco.com/gc124/gs124_27.html>.

"Super Senior Power Stretcher," Product Sheet for 10-222, Roberts Consolidated Industries, Inc., Boca Raton, FL, date unknown, 2 pages.

* cited by examiner

*Primary Examiner*—Emmanuel M Marcelo
(74) *Attorney, Agent, or Firm*—Fish & Richardson P.C.

(57) ABSTRACT

A compact carpet stretching apparatus may include a frame member, floor engagement members, and a head unit configured for use without extension poles. In one illustrative embodiment, the stretcher apparatus includes a head unit to engage a portion of a web of carpet, frame side members spaced laterally of the head unit that extend from the rear of the head unit past the front end of the head unit, and floor engaging anchors coupled to the frame side members proximal to the front portion.

48 Claims, 9 Drawing Sheets

COMPACT CARPET STRETCHER

TECHNICAL FIELD

The subject matter described herein relates to web tensioning apparatus and methods, and in preferred embodiments to compact and light-weight carpet stretching tools.

BACKGROUND

When carpet is installed between opposing walls, the carpet material is often secured to the underlying floor along the perimeter of the floor area. Thin strips of wood having carpet-gripping tacks protruding upwards therefrom (known as "tack strips") are fastened to the periphery of the floor area in order to secure the underside of the carpet to the floor. In general, the carpet is secured to the tack strips along one perimeter of the floor area, and then the carpet is stretched across the floor area so that it conforms to the surface on which it is installed. Next, the stretched carpet is secured to the tack strips along an opposite edge of the floor area. This process is repeated with the remaining unsecured edges of the carpet, until the carpet has been stretched and installed as desired. Optionally, the carpet may be more permanently secured to the floor by flattening the tacks in the tack strip using a hammer or other suitable tool.

Carpet installers typically use a stretching tool consisting of a long multi-piece tube with a carpet-engaging head at one end of the tube and a pressure plate at the other end of the tube. A desired pole length is achieved by insertion of extension poles. The pressure plate is placed against a first wall, and the head is placed in engagement with carpet near a second, opposing wall. A lever is then actuated to extend the head toward the second wall, forcing the head away from the pressure plate. The carpet is thereby stretched in a direction away from the first wall and toward the second wall. The stretched carpet is pressed down on the tack strips near the head unit and the operation is repeated.

Such stretching tools are typically ported to a room in pieces and assembled inside the workspace. This is due to the fact that in its assembled form, a conventional stretcher can easily exceed 20–25 feet in length. A number of extension poles sections are carried to the worksite together with the pressure plate and head units, after which the stretcher is assembled.

The aggregate weight of such stretching apparatus often exceeds 90 pounds. Especially for installation of carpet in large rooms, a substantial number of poles are used to construct the stretching apparatus. The combined weight of the poles, the head unit and the pressure plate section usually varies from about 80 to 100 pounds.

The weight and size of the conventional stretching apparatus are factors during transportation of the stretcher from one worksite to another. An appropriate amount of cargo space in the installer's van or truck is typically set aside for various head units, pressure plates and the set of extension poles.

The size and girth of the conventional stretcher unit affect the ease and speed with which an installer may complete a carpet installation. During a typically installation, the carpet is stretched at lateral intervals of about 2–4 feet. For an average room, this involves moving the stretcher about 5–10 times for each wall. The speed and ease with which the stretcher can be relocated may have a significant affect on installation times.

The size, weight, and number of component parts also affect the cost of the stretching unit. The weight of the unit affects raw material and shipping costs and the number of components generally affects design and manufacturing cost.

The anchoring method can affect the likelihood that the workspace is damaged. In conventional systems the pressure plate is often placed against the opposing baseboard or wall in which case care should be taken not to damage the baseboard or wall during a stretching operation. If too much force is applied during the stretching operation, the pressure plate may cause cracking, indentation, or other damage to the baseboard or wall against which it is pressed.

The flexibility of the system to work on concrete floors may also present an issue. The addition or substitution of auxiliary components may be needed to adapt a stretching system to stretch carpet over concrete subfloors. These additional components impact system cost, transportation difficulty and set-up time.

The room size and configuration may also pose limitations. Typically carpet is stretched by anchoring the system against the opposing wall. If an expanse of carpet is to be stretched over a tack strip which does not face an opposing wall, alternate methods and/or tools may be required to complete the installation. The same may be true for rooms exceeding the combined length of extension poles on hand or the maximum recommended length of a stretching unit, beyond which the extension poles may bow.

SUMMARY

A compact carpet stretching apparatus may include a frame member, floor engagement members, and a head unit configured for use without extension poles. In one illustrative embodiment, the stretcher apparatus includes a head unit to engage a portion of a web of carpet, frame side members spaced laterally of the head unit that extend from the rear of the head unit past the front end of the head unit, and floor engaging anchors coupled to the frame side members proximal to the front portion.

In another illustrative embodiment, a stretcher apparatus includes a head unit having a front side and a rear side and having one or more downwardly projecting members to engage a portion of a web of carpet. The apparatus may also include a frame member that is movably coupled to the head unit such that the head unit is operable to move in a longitudinal direction. The stretcher apparatus may further include a plurality of curved anchors to removably couple the frame member to a floor. Each of the curved anchors may have an arcuate body portion and may be coupled to the frame member such that the anchors are disposed laterally and forwardly of the head unit.

This and other embodiments may be configured to provide one or more of the following advantages. First, the unit may be compact, light-weight, and adapted to operate without the use of extension poles. Second, the stretcher may be configured to stretch carpet without the use of a pressure plate on an opposing wall. Third, the unit may be configured to be used directly on both wood and concrete subfloors. Fourth, the unit in various embodiments may be easily repositioned between stretching operations. Fifth, the unit may optionally consist of a relatively small number of component parts, thereby reducing manufacturing cost. Sixth, certain embodiments may substantially reduce installer set-up time. Seventh, some embodiments may permit the installer to postpone trimming the carpet's edge until after all or a substantial portion of the carpet has been stretched. Some or all of these and other advantages may be provided by the stretching systems described herein.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION OF ILLUSTRATIVE EMBODIMENTS

Figure 1:
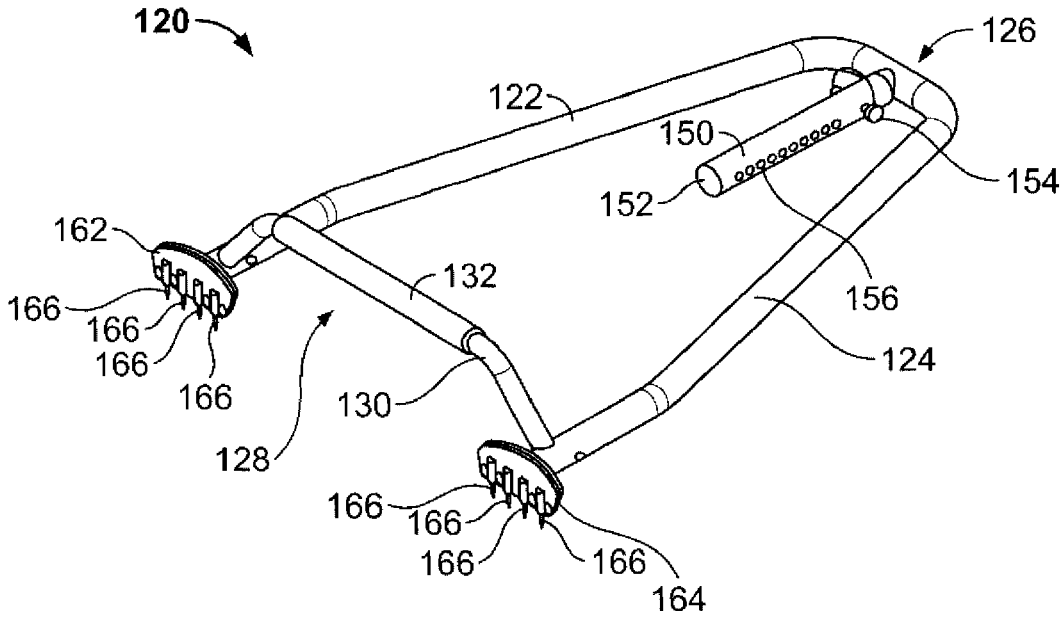
FIG. 1 is a perspective view of a portion of a stretcher apparatus in accordance with an embodiment of the invention.

Referring to FIG. 1, a stretcher apparatus includes a frame member 120 having arms 122 and 124 that join at a rear portion 126 and extend toward a front portion 128. The arms 122 and 124 are separated at or near the front portion 128, and a support member 130 extends between the arms 122 and 124. The support member 130 provides mechanical support for the frame member 120 during the stretching operation. In this embodiment, the support member 130 acts as a bridge that spans between the arms 122 and 124 proximal to the front portion 128 and may include a handle bar 132 that is suitable for grasping by a user.

An adapter shaft 150 extends from the rear portion 126 toward the front portion 128. A receiving end 152 operates to receive a head-moving mechanism so that a head unit is positioned at or near the front portion 128 (described in more detail in connection with FIGS. 2–3). Thus, the adapter shaft 150 is used to couple the head-moving mechanism to the frame member 120. In this embodiment, the adapter shaft 150 is coupled to the frame member 120 using a locking pin 154, but other suitable connecting devices may employed to couple the adapter shaft 150 to the frame member 120. Alternatively, the adapter shaft 150 may be coupled to the frame member 120 by welding or integrally forming the adapter shaft 150 with the frame member 120. Such a coupling may reduce swaying movement of the stretcher head unit during the stretching operation.

The adapter shaft 150 includes a set of holes 156 that are separated along the longitudinal direction extending from the rear portion 126 to the front portion 128. These holes 156 may be used to couple the head-moving mechanism to the adapter shaft 150 using a locking pin or another suitable connecting device (described in more detail in connection with FIGS. 2–3). The head-moving mechanism may be coupled to the adapter shaft 150 at various positions by inserting the locking pin in different holes 156.

Still referring to FIG. 1, two engagement members 162 and 164 are coupled to the arms 122 and 124, respectively, proximal to the front portion 128. Each engagement member 162 and 164 operates to removably couple the frame member 120 to the floor area. In this embodiment, each engagement member 162 and 164 includes one or more pin anchors 166 extending downwardly. These anchors 166 may be used to temporarily couple the frame member 120 to the floor area. The engagement members 162 and 164 may be integrally or releasably coupled to the frame member 120. In one example, the engagement members 162 and 164 may be releasably coupled to the frame member 120 using conventional quick-connect devices so that a user could attach different types of engagement members depending on the floor surface. In other embodiments, the engagement members 162 and 164 may be pivotally coupled to the arms 122 and 124 such that, after the engagement member 162 and 164 are coupled to the floor area, the rear portion 126 of the frame member 120 may rotate about a vertical axis relative to the engagement members. To implement this functionality, arms 122, 124 may be hingeably coupled the engagement members 162, 164 and the side arms 122, 124 may comprise telescoping shafts so that the adapter shaft 150 may be oriented at an angle relative to the normal axis of the tack strip and wall. In such embodiments, the user is able to adjust the direction of stretch relative to the wall, which improves the ability of the user to stretch out an undesirable area of carpet bunching or bubble.

Figure 2:
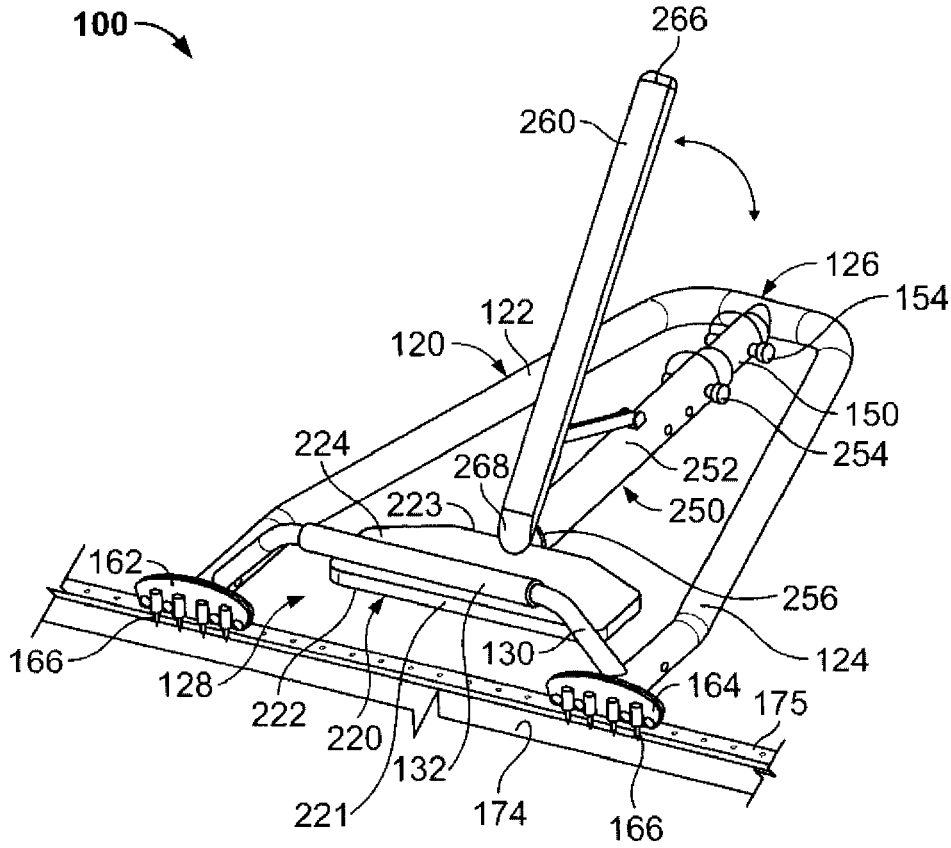
FIG. 2 is a perspective view of a stretcher apparatus in a retracted position in accordance with an embodiment of the invention.
Figure 3:
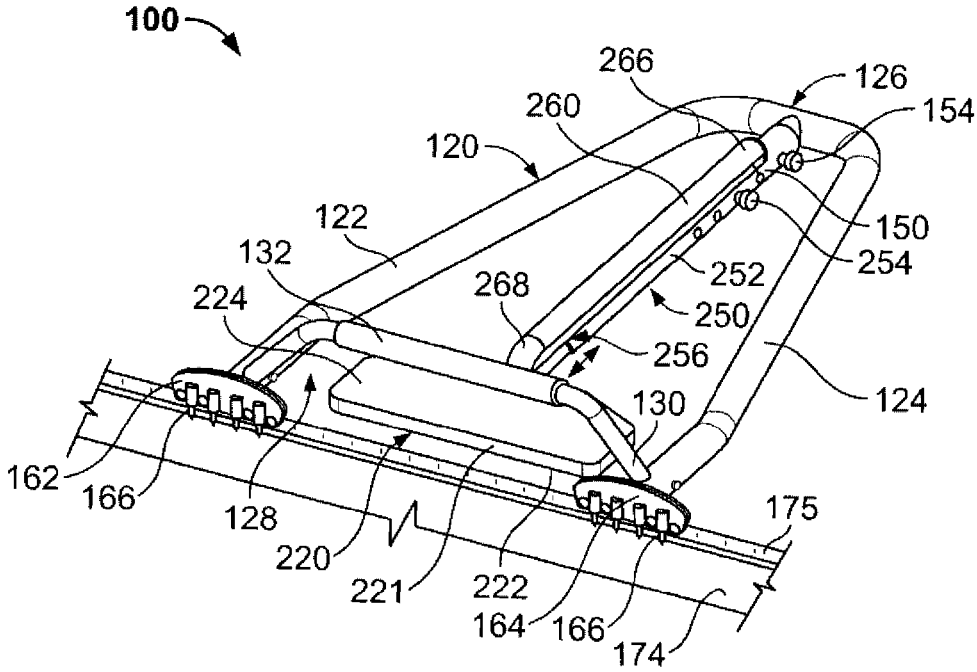
FIG. 3 is a perspective view of the stretcher apparatus of FIG. 2 in an extended position.

Referring now to FIGS. 2–3, the stretcher apparatus 100 includes a head unit 220 that can be moved in a predetermined path relative to the frame member 120. The head unit has a front side 221, a bottom side 222, a rear side 223, and a top side 224. The bottom side 222 of the head unit 220 has downwardly protruding members (not shown in FIGS. 2–3) that engage a portion of a web of carpet during the stretching operation. The top side 224 of the head unit 220 may include a flat or cushioned surface, which provides the user with an area to apply a downward force on the head unit 220. The application of such a downward force promotes engagement between the head unit 220 and the web of carpet material.

In this embodiment, a head-moving mechanism 250 provides a reciprocating motion to the head unit 220 such that the head unit 220 can be extended and retracted relative to the frame member 120. The head-moving mechanism 250 includes a connection shaft 252 that mates with the receiving end 152 (FIG. 1) of the adapter shaft 150. A locking pin 254 or other suitable connecting device may be used to couple the connection shaft 252 with the adapter shaft 150. As such, the connection shaft 252 may be coupled to the frame member 120.

In the embodiment shown in FIGS. 2–3, the adapter shaft 150 is angled slightly upward from the plane of the floor area. Accordingly, when the receiving end 152 receives a head-moving mechanism 250, the head unit 220 is positioned proximal to the front portion 128 and slightly elevated from the floor area. Thus, when the head unit 220 is forced downward to engage the carpet, the adapter shaft 150 is angularly displaced by a small amount (in some embodiments, about 2° to 4° from the plane of the floor area), which creates a moment about the frame member 120 that compels the engagement members 162 and 164 toward the floor area.

Still referring to the embodiment depicted in FIGS. 2–3, the head-moving mechanism 250 also includes a slider link 256 to guide at least a portion of the head unit's motion path. The head unit 220 is movably coupled to the connection shaft 252 by the slider link 256. The slider link 256 permits the head unit 220 to extend toward and retract from the front portion 128 of the frame member 120. In this embodiment, the slider link is a telescopic shaft 256 that moves in and out of the connection shaft 252, thus providing the head unit with a reciprocating motion path.

The head-moving mechanism 250 includes an actuation member 260 and a link 262. The actuation member 260 is movably coupled to the connection shaft 252 via the link 262. The link 262 is rotatably engaged with the connection shaft 252 such that it can pivot toward the front portion 128. The link 262 is also rotatably engaged with the actuation member 260 so that as the rear portion 266 of the actuation member 260 is moved toward the rear portion 126 of the frame member 120, the link 262 pivots toward the front portion 128 of the frame member 120.

The actuation member 260 may be movably coupled to the head unit 220 either by a rotatable engagement on the top side 224 of the head unit 220 or by a rotatable engagement on the telescopic shaft 256 near the head unit 220. In the embodiment depicted in FIGS. 2–3, the front portion 268 of the actuation member 260 is rotatably coupled to the head unit 220 so that the motion of the head unit 220 may be controlled by the actuation member 260. As shown in FIG. 2, the head unit 220 may be retracted away from the front portion 128 by moving the rear portion 268 of the actuation member 260 away from the rear portion 126 of the frame member 120. As shown in FIG. 3, the head unit 220 may be extended forward toward the front portion 128 of the frame member 120 by moving the rear portion 268 of the actuation member 260 toward the rear portion 126 of the frame member 120.

In the embodiment illustrated in FIGS. 2–3, each engagement member 162 and 164 includes one or more anchors 166 extending downwardly. These anchors 166 may be forced down upon a subfloor, biased against tack strips, or press directly into the tack strips to removably couple the frame member 120 to the floor area. As shown in FIGS. 2–3, a user may position the engagement members 162 and 164 over wood subflooring adjacent to tack strips 175 and apply a downward force on the handle bar 132 to press the anchors 166 into the wood subflooring. Moreover, the user may apply a downward force upon the head unit 220 to engage the carpet, which causes the adapter shaft 150 to be angularly displaced by a small amount and creates a moment about the frame member 120 that compels the anchors 166 to the wood subflooring. After the stretching operation is complete, the handle bar 132 may be lifted to release the stretcher apparatus 100 from the floor area. In this embodiment, each engagement member 162 and 164 includes four anchors 166 that have substantially straight bodies. Other embodiments may include a different number of anchors, such as one, two, three, five or more. Furthermore, some embodiments may include anchors having a curved body (described in more detail, for example, in connection with FIG. 17).

Figure 4:
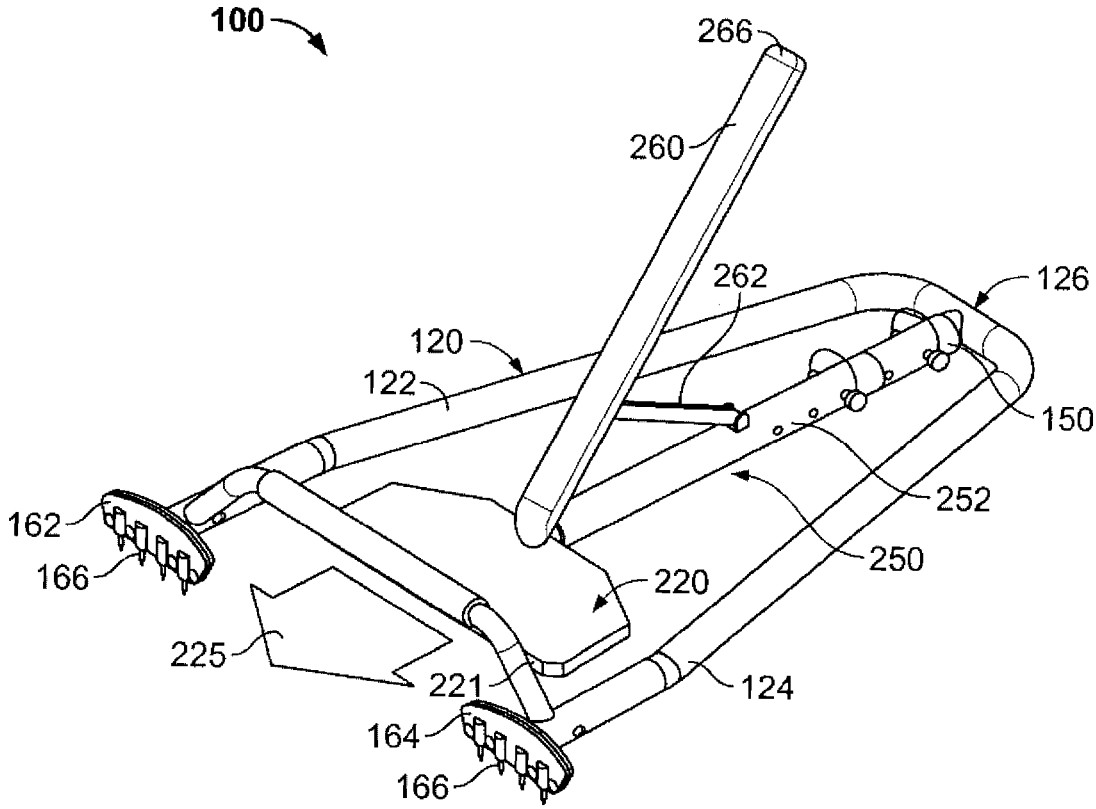
FIG. 4 is another perspective view of the stretcher apparatus of FIG. 2 in a retracted position.
Figure 5:
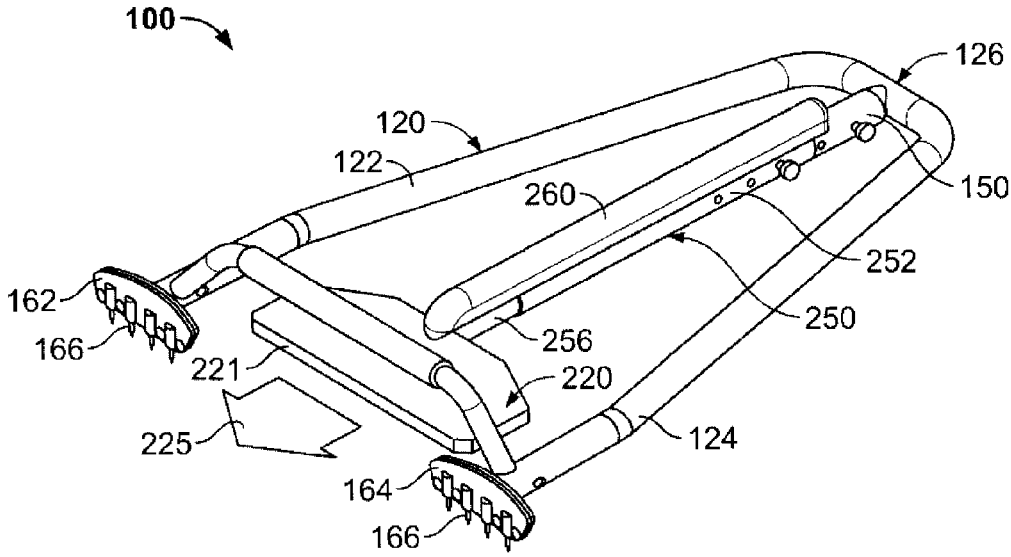
FIG. 5 is another perspective view of the stretcher apparatus of FIG. 4 in an extended position.

Referring now to FIGS. 4–5, the engagement members 162 and 164 are disposed laterally and forwardly of the head unit 220. As previously described, the head unit 220 may be extended in a direction along a longitudinal axis using the head-moving mechanism 250. The engagement members 162 and 164 are laterally offset from the head unit 220 and positioned forward of the head unit's front side 221. In this embodiment, the engagement members 162 and 164 are offset from the head unit's longitudinal path 225, which includes the space directly in front of the head unit 220. This configuration may provides the user with substantial access to the portion of the carpet that is directly in front of the head unit 220, thus simplifying the task of securing that carpet portion to the tack strips.

Figure 6:
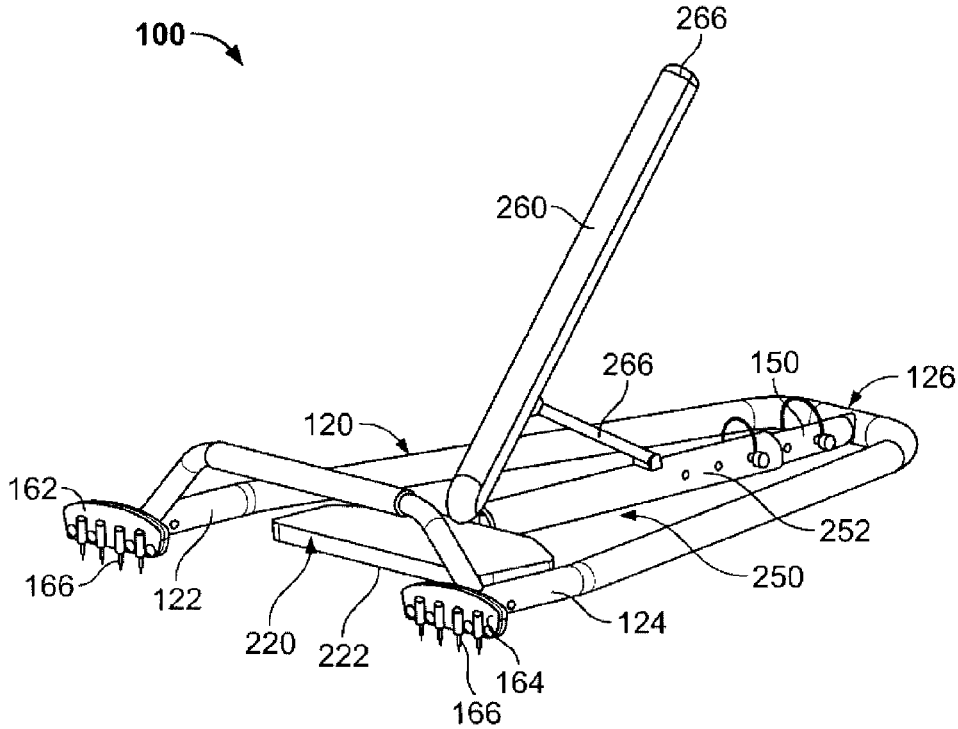
FIG. 6 is yet another perspective view of the stretcher apparatus of FIG. 2 in a retracted position.
Figure 7:
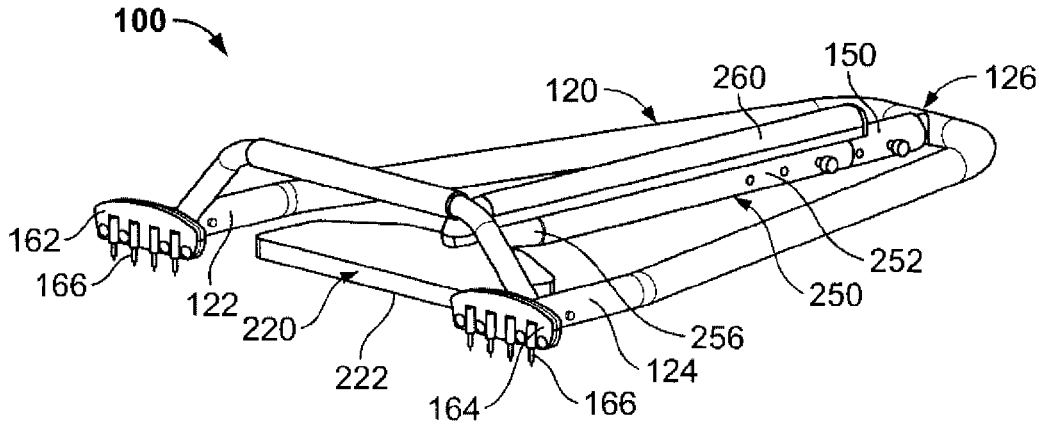
FIG. 7 is yet another perspective view of the stretcher apparatus of FIG. 6 in an extended position.

FIGS. 6–7 show alternative perspective views of the stretcher apparatus 100 when the head unit 220 is in a retracted position and in an extended position relative to the frame member 120. Other types of head-moving mechanisms may be used to move the head unit 220 in a predetermined path relative to the frame member 120. For example, the head-moving mechanism may include a hydraulic-powered cylinder that reciprocates the head unit 220 with an extending and retracting motion, in which case the actuation member include a hydraulic pump and a lever, switch, or button to activate the cylinder.

Figure 8:
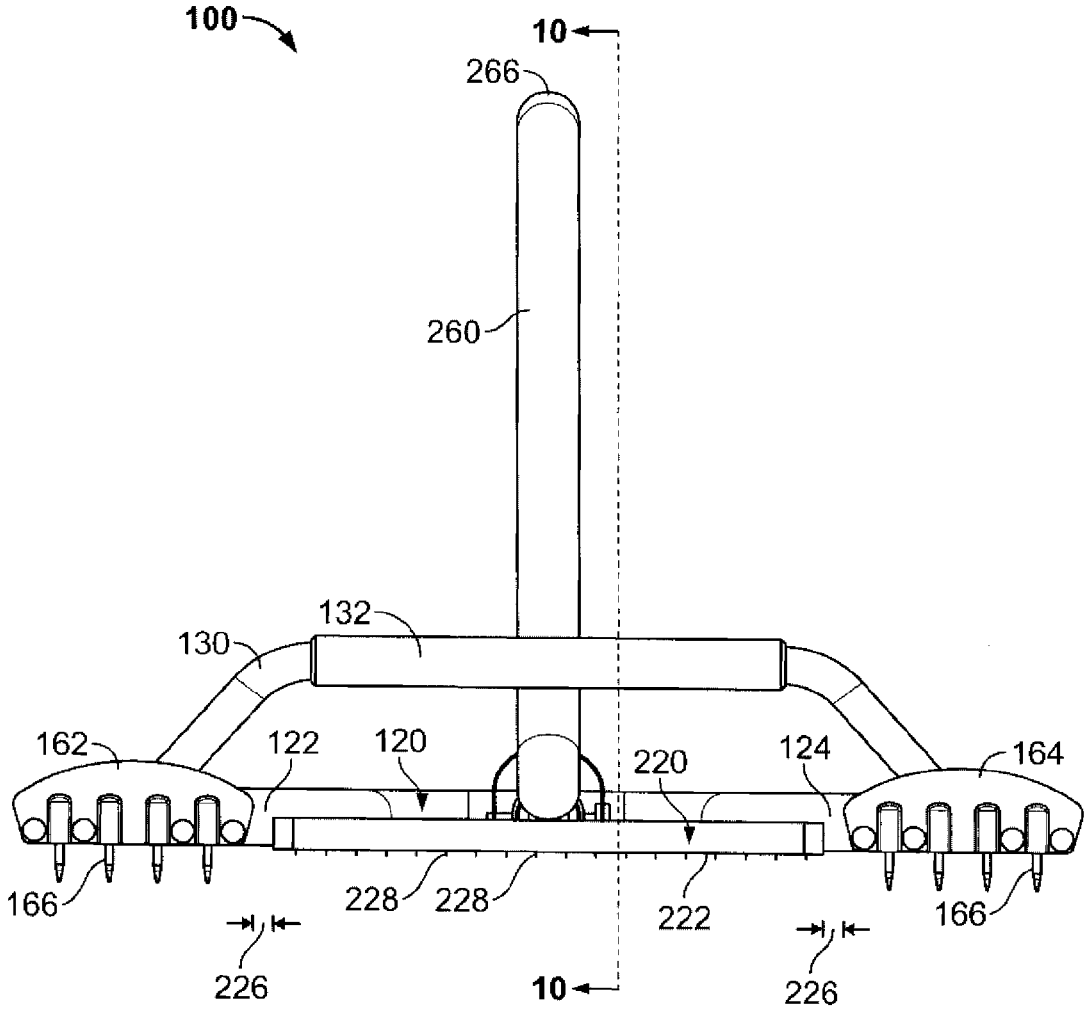
FIG. 8 is front view of the stretcher apparatus of FIG. 2 in a retracted position.
Figure 9:
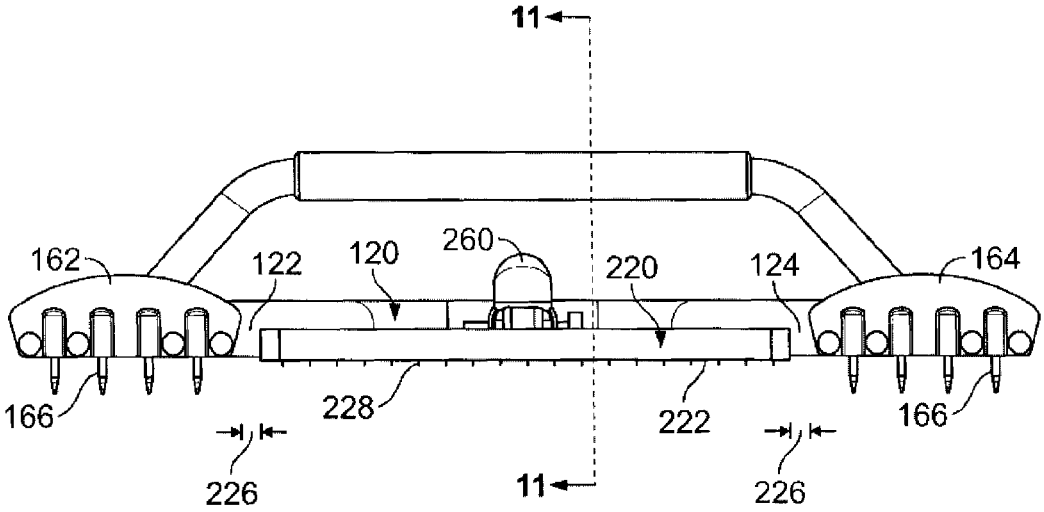
FIG. 9 is front view of the stretcher apparatus of FIG. 8 in an extended position.

Referring now to FIGS. 8–9, the engagement members 162 and 164 are laterally offset from the head unit 220. This offset 226 reduces or eliminates interference from the engagement members 162 and 164 when the head unit 220 forces the carpet edge in a longitudinal forward direction. As previously described, the head unit 220 includes downwardly protruding members, such as pin members 228, along the bottom side 222 that may be used to engage the carpet material. When the head-moving mechanism 250 extends the head unit 220 forward toward the front portion 128, at least a portion of the carpet material is forced toward the spaced in front of the head unit 220. In this embodiment, the engagement members 162 and 164 are laterally offset from the spaced in front of the head unit 220, so the user may easily handle the carpet edge directly in front of the head unit 220 and secure that portion of the carpet to the tack strips.

Figure 10:
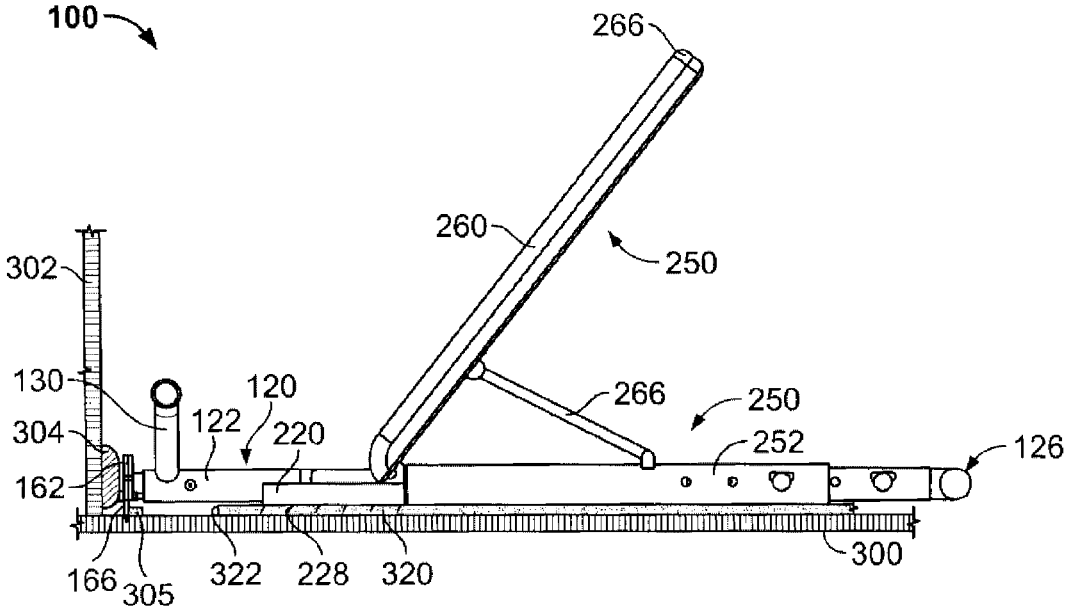
FIG. 10 is cross-sectional side view of the stretcher apparatus of FIG. 8 in a retracted position over a first floor area.
Figure 11:
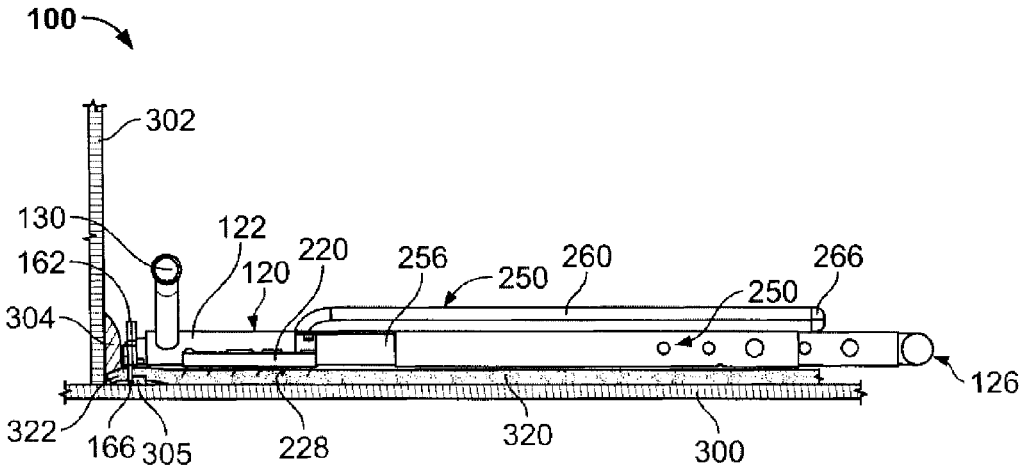
FIG. 11 is cross-sectional side view of the stretcher apparatus of FIG. 9 in an extended position over a first floor area.

Referring to FIGS. 10–11, the stretcher apparatus 100 may operate to stretch a web of carpet 320 (or a like material) over a floor area. Optionally, a padding material may be positioned over the floor area to serve as a cushion between the floor area and the carpet 320. A tack strip 305 is coupled to the periphery of the floor area 300 near a vertically extending wall 302. In this embodiment, the floor area includes wood subflooring 300 to which the tack strip 305 is secured. The tack strip 305 includes an upward extending tack or other pointed element to secure the carpet 320 proximal to the wall 302. In many instances, it is preferable to stretch the carpet 320 before securing it to the tack strip 305 so that the carpet satisfactorily conforms to the surface of the floor area 300.

In the embodiment shown in FIG. 10, the stretcher apparatus 100 is removably coupled to the floor area 300 by the anchors 166 of the engagement members 162 and 162 (member 164 is not shown in FIGS. 10–11). The anchors 166 are pressed into wood subfloor 300 in a gap between the tack strip 305 and a baseboard 304 on the wall 302. In this configuration, the anchors 166 on the engagement member 162 and 164 removably couple the frame member 120 to the floor area 300.

Alternately or additionally, the anchors 166 may rest against the vertical surface of tack strip 305. During a stretching operation, the tack strip 305 would resist horizontal movement of the stretcher 100, thereby serving to anchor the stretcher 100 relative to the carpet to be stretched.

Still referring to FIG. 10, the stretcher apparatus 100 is positioned over the carpet 320 and the head unit 220 is in a retracted position. The pin members 228 of the head unit 220 are engaged with the carpet 320 such that the carpet edge 322 will be forced toward the wall 302 when the head unit 220 is extended toward the wall 302. As previously described, when the rear portion 266 of the actuation member 260 is moved toward the rear portion 126 of the frame member 120, the head-moving mechanism 250 causes the head unit 220 to extend longitudinally forward (toward the wall 302).

Referring now to FIG. 11, the head unit 220 is forced to an extended position and the carpet 320 is stretched, thus moving the carpet edge 322 toward the wall 302. The anchors 166 retain the frame member 120 in position as the head unit 220 applies a force to stretch the carpet 320. If the user decides that the carpet 320 requires additional stretching (e.g., there is still a significant amount of slack in the carpet 320), the user may retract the head unit 220 while leaving the anchors 166 and frame member 120 in place. The head unit 220 may be retracted by moving the actuation member 260 away from the rear portion 126 of the frame member 120 (refer to FIG. 10). The pin members 228 may briefly disengage the carpet 320 while the head unit 220 moves in a rearward direction relative to the carpet. However, the pin members 228 substantially maintain the carpet 320 in the stretched state because the pin members 228 can engage the carpet 320 if the carpet begins to move rearwardly relative to the head unit 220. After the head unit 220 is in a retracted position, the actuation member 260 may again be moved toward the rear portion 126 of the frame member 120 to extend the head unit 220 toward the wall 302 and stretch the carpet 320 even further.

After the carpet 320 has been stretched, the user may leave the head unit 220 in the extended position (FIG. 11) so that the carpet 320 remains stretched, and the user may handle the carpet edge 322 to secure the carpet 320 to the tack strip 305. In this embodiment, the depicted web of carpet is provided at a proper length (e.g. as by previous trimming), so the portion of the carpet edge 322 directly in front of the head unit 220 may be tucked into a gap between the baseboard 304 and the wood subfloor 300. Because the engagement members 162 and 164 are disposed laterally and forwardly of the head unit 220, the stretcher apparatus 100 may provide the user with substantial access to that portion of the carpet edge 322 directly in front of the head unit 220. After that portion of the carpet 320 directly in front of the head unit 220 is stretched and secured to the tack strip 305, the user may lift the anchors 166 from the floor area 300 and repeat the stretching operations at an adjacent location on the floor area 300.

Figure 12:
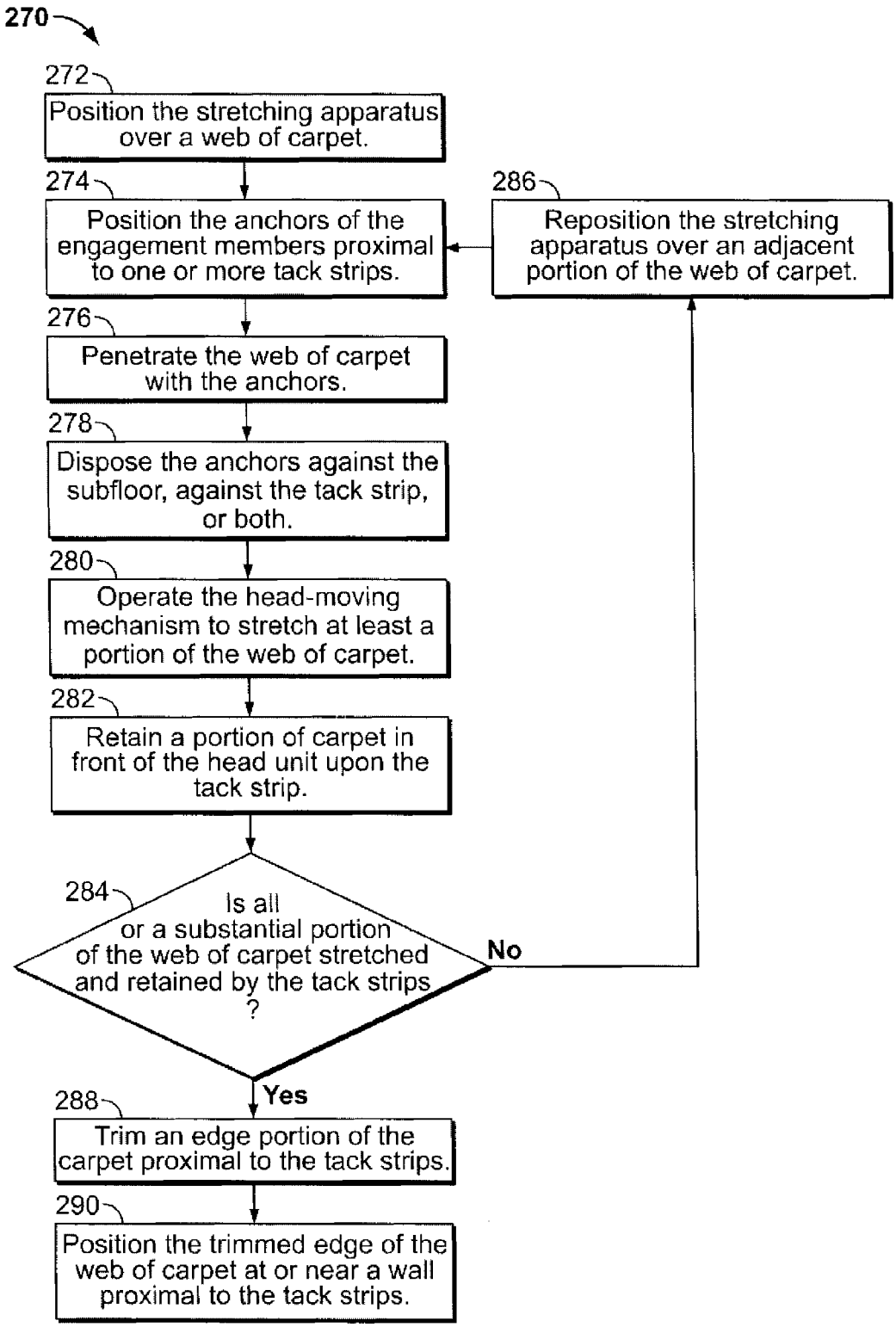
FIG. 12 is a flow diagram of an installing method in accordance with an embodiment of the invention.

Referring to FIG. 12, in some embodiments, the stretcher apparatus 100 may be used in a method 270 so that the user trims the carpet after all or a substantial portion of the carpet has been stretched and retained on tack strips along an expanse of a wall. In such instances, the stretcher apparatus 100 may be operated to stretch a portion of a web of carpet, then moved to stretch an adjacent portion of carpet, and so forth until all or a substantial portion of the carpet has been stretched. Subsequently, the installer may trim all or a substantial part the edge portion near the tack strips in one quick step, thus preventing the need to trim individual edge portions after each stretching operation.

In one embodiment of the carpet installation method 270, the user positions 272 the stretcher apparatus 100 over a web of carpet. The user then positions 274 the anchors 166 of the engagement members 162 and 164 proximal to one or more tack strips. In some instances, this positioning can be accomplished by moving the engagement members 162 and 164 near a wall along which the tack strips are disposed. Next, the user urges the assembly downward, thus causing the anchors 166 to penetrate the carpet. In presently preferred embodiments, the anchors 166 have a tapered end such that the carpet can be penetrated by merely applying a downward force to the engagement members 162 and 164. After the carpet is penetrated 276, the user may dispose the anchors 166 against the subfloor, against the tack strip, or both. As previously described, this step may be performed to removably couple the anchors 166 to the floor area. The user then operates 280 the head-moving mechanism 250 to stretch a portion of the web of carpet. In some instances, the head-moving mechanism 250 may force the head unit 220 toward the wall so as to stretch a portion of the carpet in a longitudinal direction. Next, the user secures 282 a portion of the carpet in front of the head unit 220 to the tack strip(s). Even though the adjacent portions of carpet through which the anchors 166 have penetrated will not necessarily be moved by the head unit 220, those adjacent portions may be stretched in subsequent operations after the stretcher apparatus 100 is lifted and repositioned (or may have been stretched and retained to the tack strip when the stretching apparatus was in a previous position).

In this embodiment of the method 270 depicted in FIG. 12, if the user has other, adjacent portions of the web of carpet yet to be stretched, the user may reposition 286 the stretcher apparatus 100 over the adjacent portion of the web of carpet simply by lifting the assembly by the handle and placing the assembly over an unstretched portion of the web of carpet. In presently preferred embodiments, the assembly may be ported with a single hand. Then, the user repeats the previously described operations (depicted as actions 274–282) at the new position of the stretcher apparatus 100.

If all or a substantial portion of the web of carpet has been stretched and retained by the tack strips, the user then trims 288 an edge portion of the carpet proximal to the tack strips along the length of the web of carpet. Then, the user positions 290 the trimmed edge of the web of carpet at or near a wall proximal to the tack strips. In some instances, this action may be accomplished by fitting the carpet edge into a gap between the baseboard and a subfloor (as previously described in connection with FIGS. 10–11). Because the installer may trim all or a substantial part the edge portion near the tack strips in one simple action, the stretcher apparatus 100 may alleviate the need to trim individual edge portions after each stretching operation.

Figure 13:
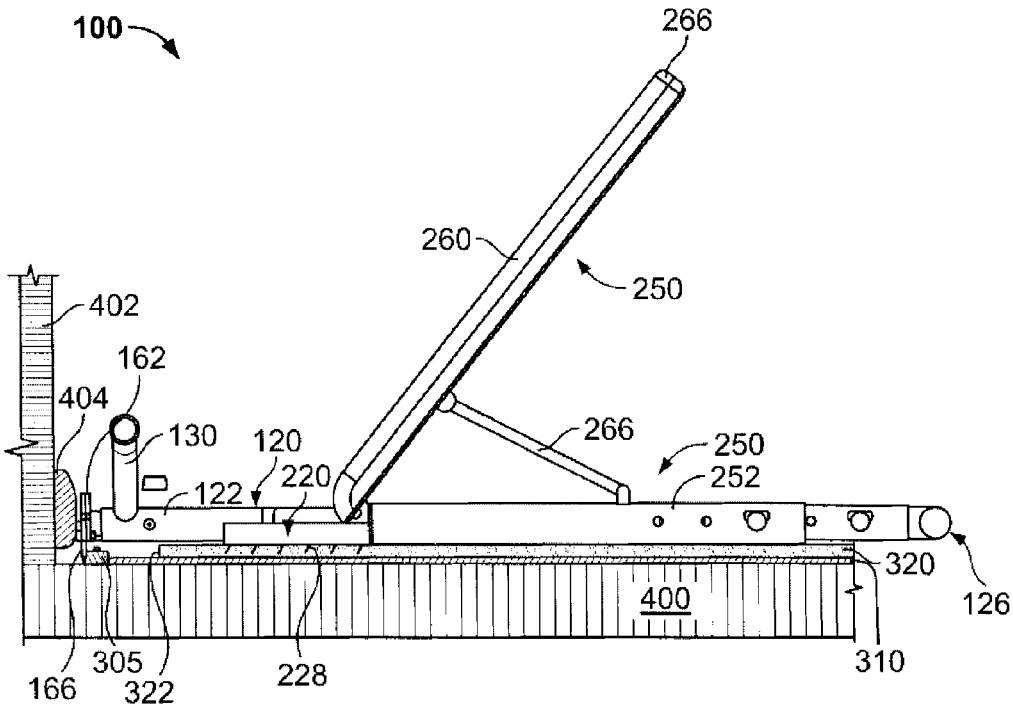
FIG. 13 is cross-sectional side view of the stretcher apparatus of FIG. 8 in a retracted position over a second floor area.
Figure 14:
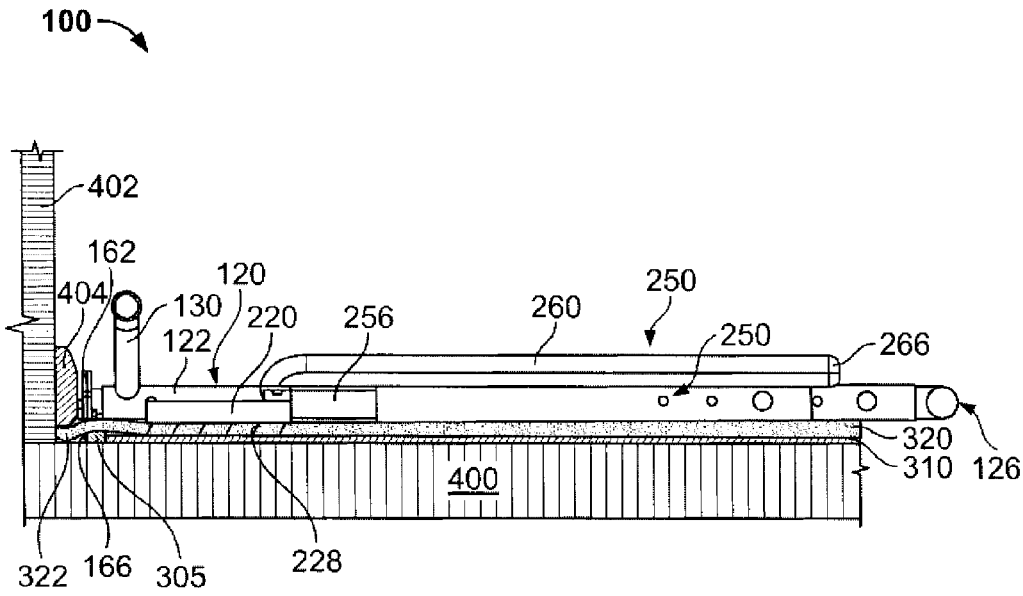
FIG. 14 is cross-sectional side view of the stretcher apparatus of FIG. 9 in an extended position over a second floor area.

Referring now to FIGS. 13–14, the stretcher apparatus 100 may be used to stretch a web of carpet 320 (or a like material) over a different floor area, such as concrete subflooring 400. In this embodiment, a padding material 310 is positioned over the concrete floor area 400 to serve as a cushion between the concrete and the carpet 320. A tack strip 305 is coupled to the periphery of the floor area 400 near a vertically extending wall 402. The tack strip 305 includes an upward extending tack or other pointed element to secure the carpet 320 proximal to the wall 402.

As shown in FIG. 13, the stretcher apparatus 100 is removably coupled to the concrete floor area 400 by the anchors 166 of the engagement members 162 and 164 (member 164 is not shown in FIGS. 13–14). The anchors 166 are position on the concrete subfloor 400 in a gap between the tack strip 305 and a baseboard 404 on the wall 402. In this embodiment, the anchors 166 are biased against the tack strip 305 during the stretching operation so that the frame member 120 is removably coupled to the floor area 400.

Referring now to FIG. 14, the head unit 220 is forced to an extended position and the carpet 320 is stretched, thus moving the carpet edge 322 toward the wall 402. The anchors 166 are biased against the tack strip 305 to retain the frame member 120 in position as the head unit 220 applies a force to stretch the carpet 320. After the carpet 320 has been sufficiently stretched, the user may leave the head unit 220 in the extended position (FIG. 14) so that the carpet 320 remains stretched, and the user may handle the carpet edge 322 to secure the carpet 320 to the tack strip 305. In this embodiment, the depicted web of carpet has already been trimmed to a proper length, so the portion of the carpet edge 322 directly in front of the head unit 220 may be tucked into a gap between the baseboard 404 and the concrete subfloor 400. After that portion of the carpet 320 directly in front of the head unit 220 is stretched and secured to the tack strip 305, the user may lift the anchors 166 from the floor area 400 and repeat the stretching operations at an adjacent location on the floor area 400. Alternatively, the user may employ the method depicted in FIG. 12 so that the carpet is trimmed in a single operation after all or a substantial portion of the carpet has been stretched and retained on tack strips along an expanse of a wall.

It should be understood that the depicted amount of stretching that the carpet 320 undergoes in FIGS. 10–11 and 13–14 is merely figurative. The actual distance a carpet material is stretched may be a greater or lesser amount, as will be understood by those skilled in the art.

Figure 15:
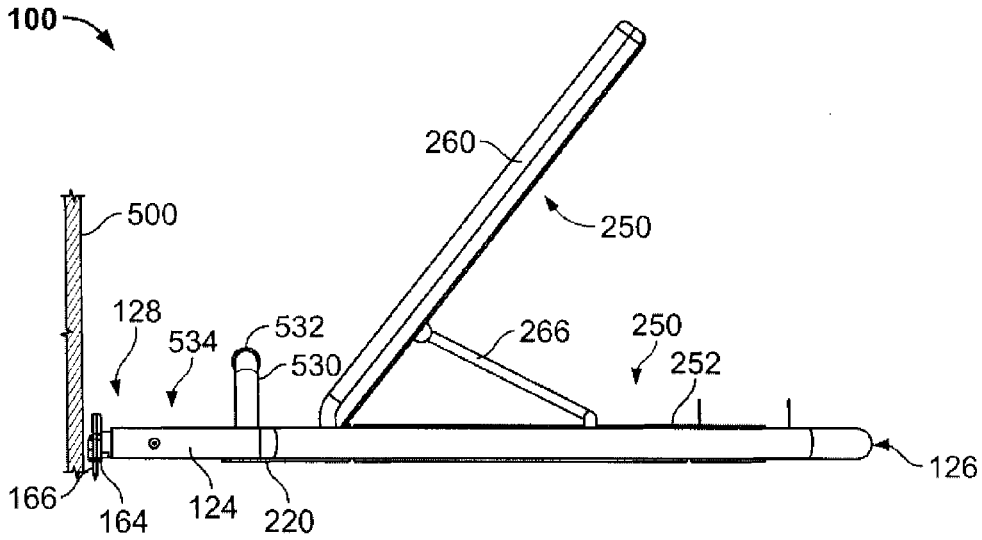
FIG. 15 is a side view of a stretcher apparatus in a retracted position in accordance with an embodiment of the invention.
Figure 16:
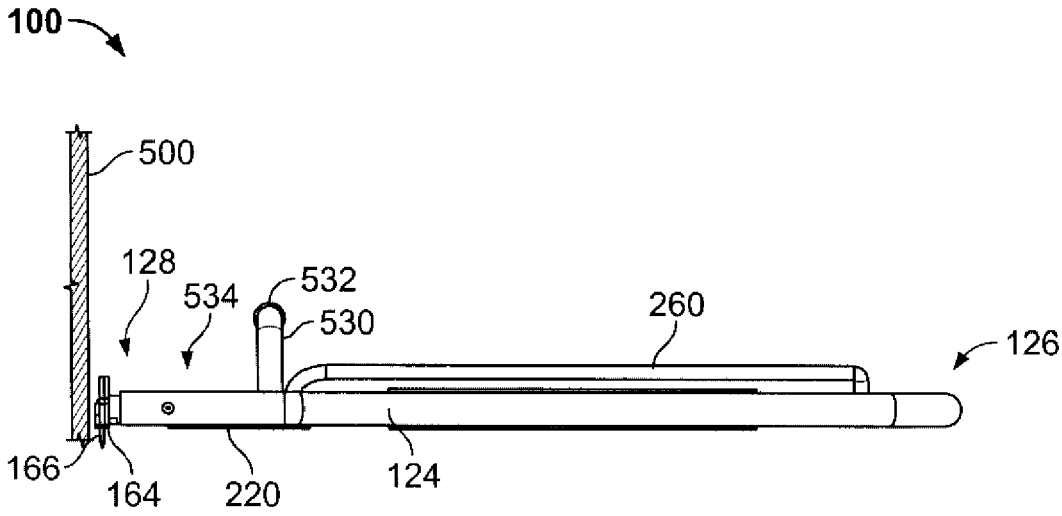
FIG. 16 is a side view of the stretcher apparatus of FIG. 15 in an extended position.

Referring to FIGS. 15–16, in another embodiment of the stretcher apparatus 100 the support member 530 is disposed rearwardly relative to the support member shown in the aforementioned embodiments. In this embodiment, the support member 530 is disposed proximal to the front portion 128 yet rearwardly of the head unit 220 when the head unit 220 is in an extended position (as perhaps best shown in FIG. 16). Accordingly, a user has greater access to a space 534 between the support member 133 and a wall 500, which may simplify handling and securing operations that occur after the head unit 220 is extended to stretch the carpet. In the presently preferred embodiment, the support member is disposed between about 10 to 14 inches aft of the engagement members 162, 164. Similar to the support member 130 described in previous embodiments, the support member 530 depicted in FIGS. 15–16 extends between the arms 122 and 124 (arm 122 is not shown in FIGS. 15–16) and provides mechanical support for the frame member 120 during the stretching operation. The support member 530 may act as a bridge that spans between the arms 122 and 124 proximal to the front portion 128 and may include a handle bar 532 that is suitable for grasping and lifting by a user.

Figure 17:
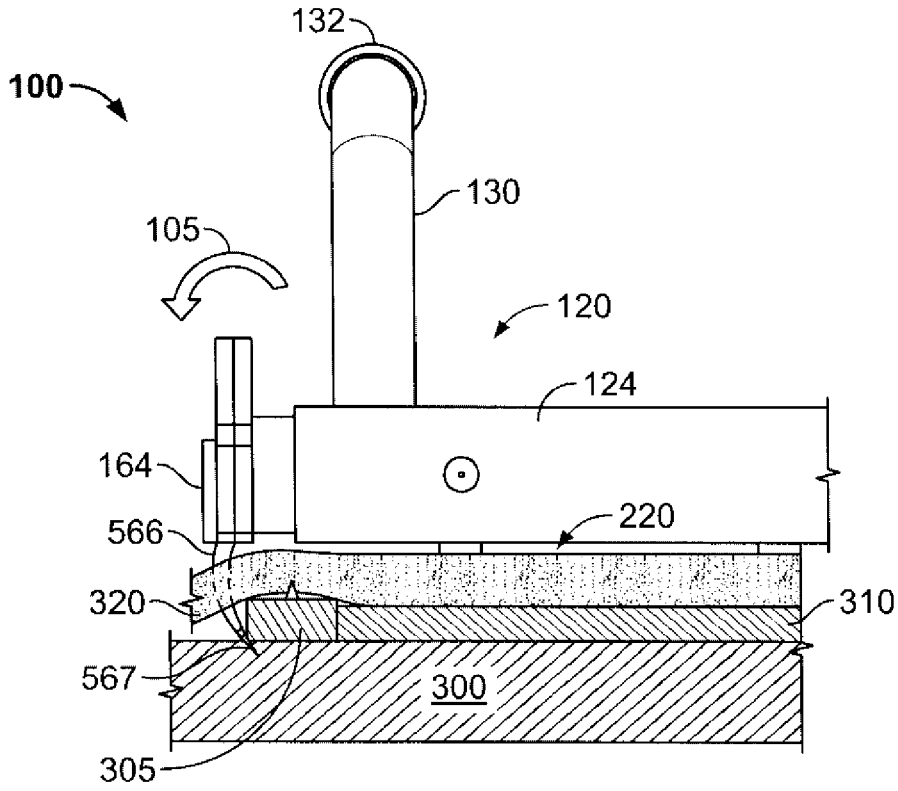
FIG. 17 is a close-up side view of a portion of a stretcher apparatus in accordance with another embodiment of the invention.

Referring now to FIG. 17, the anchors 566 may comprise an arcuate or curved body portion that may provide an improved coupling between the frame member 120 and the floor area during the stretching operation. Each engagement member 162 and 164 may include one or more of the curved anchors 566 that extend downwardly from the engagement members 162 and 164 to temporarily couple the frame member 120 to the floor area. In this embodiment, each curved anchor 566 has a body that extends downward from the engagement member 162 or 164 and curves at least partially rearward. Each anchor 566 include a tip portion 567 that is adapted to penetrate a web of carpet, be forced into a subfloor, be biased against tack strips, or any combination thereof.

As shown in FIG. 17, a user may position the engagement members 162 and 164 over a subfloor 300 and apply a downward force on the handle bar 132 to force the curved anchors 566 through the carpet 320 and into the wood subflooring 300. Before (and possibly during) extension the head unit 220 to stretch the carpet, the user may apply a downward force upon the head unit 220 to engage the carpet, which causes the adapter shaft 150 to be angularly displaced by a small amount and creates a moment 105 about the frame member 120 (as previously described, for example, in connection with FIGS. 2–3). This moment 105, combined with the curved body of the anchors 566, may be significantly effective to further compel the anchors 566 to couple with the subflooring 300, the tack strips 305, or both. The tip portions 567 may be at least partially lodged between the tack strip 305 and the subfloor 300 such that the anchors 566 effectively secure the stretching apparatus 100 to the floor area. After the stretching operation is complete, the handle bar 132 may be lifted to release the stretcher apparatus 100 from the floor area.

In presently preferred embodiments, the degree of curve of the anchors 566 is selected so as to balance the ability of a user to penetrate the carpet upon application of a downward force on the bridge or handle member (which generally militates in favor of a more vertical anchor), clearance between the tack strip and the wall or baseboard (which also typically militates in favor of a more vertical anchor), and the ability to set into the tack strip and/or floor upon application of a horizontal (i.e. stretching) force (which generally militates in favor of a more curved anchor). To limit deflection, deformation, and dulling of the anchors, it is presently preferred to construct the anchors of hardened steel.

Consistent with the foregoing teaches, the anchors 166 may instead comprise a downwardly projecting flange, hook, rod, or channel. In the case of a flange, the flange may have a rearwardly projecting lip to promote engagement with the tack strip. Downwardly projecting hooks may likewise be configured so that the tip of the hook engages the tack strip. Rods may be used in lieu of the depicted pins where it is not desired that the anchors penetrate a wood subfloor or become dull upon contact with concrete subfloors. Channel-type anchors may be used to cover and engage both sides of the tack strips.

The anchors may be be advantageously configured to be removable. For instance, the anchors may be threadably engage with the engagement members 162, 164 and include flatten peripheral portions to facilitate removal of the anchors with a hand tool such as a box end wrench. A quick-release system may be included where it is desired to permit the installer to exchange anchor types at the worksite. An example of such a quick-release system is a series of balls and springs in the engagement members that releasably engage detents in the pins or rods.

In other embodiments, the apparatus 100 may include more than two engagement members 162 and 164. For example, each arm 122 and 124 of the frame member 120 may have two, three, four or more engagement members coupled thereto. Such an embodiment can substantially increase the hold of the frame member 120 to the floor area during the stretching operation.

The arm members 122 and 124 and engagement members 162 and 164 may be spaced a greater lateral distance from the head unit to facilitate installer access to the stretched region of the carpet. Wider frame spans may also permit a greater number of reciprocal stretching actuations without removal and reseating of the anchors to alleviate wrinkling or gathering of the carpet around the anchors. In the depicted embodiment, the engagement members are laterally spaced about two inches from head unit. In other embodiments, the engagement members may be spaced about 5, 10, 18, or 24 inches from the head unit.

Consistent with the foregoing teachings, the frame member 120 may be hinged or flexible. A locking hinge may be provided to allow each side of the frame to move relative to one another and then be locked into fixed positions at desired times. Flexible frame members may be formed of moderate elastic modulus polymer to enhance system durability and in some embodiments reduce weight.

The support member 130 or 530 may be equipped with an ergonomically contoured handle section to facilitate grasping by a use. In certain embodiments, two such handles may be provided to permit a user to set the anchors in a wood subfloor by bearing down on the handles with both hands. Multiple handle bar sections may be provided to provide additional rigidity and/or grip points. The rigidity provided by the handle bar or bridge bar may facilitate movement of the device from one stretching location to another and promote product longevity.

The actuation member may optionally be built into the support member or frame arms. For instance, the head-moving mechanism may be disposed proximate the engagement members 162 and 164 and the support member 130 may pivot relative to the frame arms 122 and 124. The head-moving mechanism may actuated by grasping the handle portion 132 and pivoting the support member 130 relative to the frame arm 122 and 124. In such embodiments, simplified head units without actuation members may be used. Such embodiments may promote stretching effectiveness by permitting the installer to bear down on the handle/actuation member with more weight. The handle/actuation member in such embodiments may extend further from the frame members to increase leverage.

The adaptor shaft 150 may also be provided with a quick-release system similar to that described above in connection with the anchors 166 or 566. In this embodiment, an installer may readily exchange head units when, for instance, a different type of carpet is to be stretched.

In some embodiments, the stretcher apparatus may include anchor guards to reduce the likelihood of incidental damage from the anchors while transporting and positioning the stretcher apparatus. The anchor guards may comprise a moldable plastic material that is shaped and configured to have a press fit over the tips of the anchors. In some packages, the stretcher apparatus may include one anchor guard for each engagement member. Each anchor guard may be provided with holes or slots to receive the anchors such that the anchors are surrounded by the plastic material to protect against incidental damage or harm.

A number of embodiments of the invention have been described. Nevertheless, it will be understood that various modifications may be made without departing from the spirit and scope of the invention. Accordingly, other embodiments are within the scope of the following claims.

What is claimed is:

1. A stretching apparatus, comprising:

a head unit having a front side and a rear side and having one or more downwardly projecting members to engage a portion of a web of carpet;

a frame member movably coupled to the head unit such that the head unit is operable to move in a longitudinal direction, wherein the frame member comprises a front portion and a rear portion, a first and second side portions extending from proximal the rear portion to proximal the front portion, and a support member disposed proximal the front portion and spanning between the first and second side portions; and a plurality of curved anchors to removably couple the frame member to a floor, each of the curved anchors being coupled to the frame member and having a curved body portion, wherein each of the curved anchors are disposed laterally and forwardly of the head unit.

2. The apparatus of claim 1, wherein each anchor includes a tip portion to penetrate a web of carpet.

3. The apparatus of claim 1, wherein the support member comprises a handle by which the carpet stretching apparatus may be transported with a single hand.

4. The apparatus of claim 1, wherein the frame member includes an adapter member movably coupled with the head unit, the adapter member extending from proximal the rear portion toward the front portion, wherein the adapter member is angled upward relative to the floor.

5. The apparatus of claim 4, wherein when the head unit is forced downward to engage the web of carpet, a moment is created about the frame member that compels the anchors toward the floor.

6. The apparatus of claim 1, wherein the plurality of curved anchors are operable removably couple the frame member to the floor by engagement with a tack strip.

7. The apparatus of claim 1, wherein each of the first and second side portions has at least one of the curved anchors coupled thereto proximal the front portion.

8. The apparatus of claim 7, wherein each of the first and second side portions has at least three curved anchors coupled thereto.

9. The apparatus of claim 1, further comprising at least one anchor guard adapted to substantially cover at least a portion of one or more of the curved anchors, the anchor guard comprising a moldable plastic material.

10. The apparatus of claim 1, wherein the head unit is removably coupled to the frame member.

11. The apparatus of claim 1, further comprising a head actuation mechanism coupled to the head unit to move the head unit in the longitudinal direction relative to the frame member.

12. The apparatus of claim 11, wherein the head actuation mechanism comprises a telescopic shaft that movably couples the head unit to the frame member, wherein the telescopic shaft substantially guides the head unit's movement in the longitudinal direction.

13. The apparatus of claim 1, wherein the first and second side portions are each rigid and unhinged.

14. The apparatus of claim 1, wherein all of the plurality of curved anchors are disposed forward of the head unit.

15. A method, comprising:

positioning a stretching apparatus over a web of carpet, the stretching apparatus including a head unit having a front side and a rear side, a frame member movably coupled to the head unit such that the head unit is operable to move in a longitudinal direction, the frame member comprising a first and second side portions extending from proximal a rear portion to proximal a front portion and a support member disposed proximal the front portion and spanning between the first and second side portions, and a plurality of anchors coupled to the frame member and disposed laterally and forwardly of the head unit;

disposing the anchors against a floor or a tack strip; and operating the stretcher apparatus to stretch at least a portion of the web of carpet.

16. The method of claim 15, further comprising securing a portion of the web of carpet on a tack strip and repositioning the stretching apparatus over an adjacent portion of the web of carpet.

17. The method of claim 16, wherein the stretching apparatus is repositioned over the adjacent portion of the web by lifting the stretcher apparatus from the floor prior to trimming the carpet's edge.

18. The method of claim 15, wherein the at least a portion of an anchor is curved.

19. The method of claim 15, further comprising penetrating the web of carpet with the anchors.

20. The method of claim 15, wherein the anchors are disposed against the tack strip.

21. The method of claim 15, wherein each of the first and second side portions has at least one of the curved anchors coupled thereto proximal the front portion.

22. The method of claim 21, wherein each of the first and second side portions has at least three curved anchors coupled thereto.

23. A carpet stretcher apparatus, comprising:

a frame member having a front portion and a rear portion, a first and second side portions extending from proximal the rear portion to proximal the front portion, and a support member disposed proximal the front portion and spanning between the first and second side portions;

an adapter portion to receive a stretcher head assembly such that, when the stretcher head assembly is received by the adapter portion, the stretcher head assembly extends in a longitudinal direction toward the front portion; and a plurality of anchors to removably couple the frame member to a floor, each of the anchors being coupled to the frame member proximal the front portion such that, when the stretcher head assembly is received by the adapter portion, each of the anchors are disposed laterally and forwardly of the stretcher head assembly.

24. The apparatus of claim 23, wherein the first and second side portions are spaced laterally of the adapter member.

25. The apparatus of claim 24, wherein the support member is rigidly connected to the first and second side portions such that substantial downward forced can be transmitted through the support member to the plurality of anchors.

26. The apparatus of claim 24, wherein when the stretcher head assembly is received by the adapter portion, each of the first and second side portions is disposed laterally of the stretcher head assembly.

27. The apparatus of claim 26, wherein each of the first and second side portions has at least one anchor coupled thereto proximal the front portion such that, when the stretcher head assembly is received by the adapter portion, each of the anchors are disposed laterally and forwardly of the stretcher head assembly.

28. The apparatus of claim 27, wherein each of the first and second side portions has at least three anchors coupled thereto.

29. The apparatus of claim 23, wherein at least a portion of an anchor is curved.

30. The apparatus of claim 23, further comprising at least one anchor guard adapted to substantially enclose at least a portion of one or more anchors, the anchor guard comprising a moldable plastic material.

31. The apparatus of claim 23, wherein the adapter portion receives the stretcher head assembly at an angled from a horizontal plane defined by the floor when the frame is removably coupled to the floor.

32. The apparatus of claim 31, wherein when the stretcher head assembly is received by the adapter portion, a carpet-engaging head unit of the stretcher head assembly is disposed proximal the front portion and elevated from the horizontal plane such that, when the head unit is forced downward to engage a web of carpet, a moment is created about the frame member that compels the anchors toward the floor.

33. The apparatus of claim 23, wherein at least one of the anchors has a tip portion to penetrate a web of carpet upon application of a downward force by a user.

34. The apparatus of claim 23, wherein the stretcher head assembly is received by the adapter portion.

35. The apparatus of claim 23, wherein the first and second side portions are each rigid and unhinged.

36. The apparatus of claim 23, wherein all of the plurality of curved anchors are disposed forward of the head unit.

37. A carpet stretcher apparatus, comprising:

a frame member having a front portion and a rear portion and first and second side portions extending from proximal the rear portion to proximal the front portion;

an adapter portion to receive a stretcher head assembly such that, when the stretcher head assembly is received by the adapter portion, the stretcher head assembly extends in a longitudinal direction toward the front portion; and a plurality of anchors to removably couple the frame member to a floor, each of the anchors being coupled to the frame member proximal the front portion such that, when the stretcher head assembly is received by the adapter portion, each of the anchors are disposed laterally and forwardly of the stretcher head assembly, wherein each of the first and second side portions has at least three anchors coupled thereto proximal the front portion.

38. The apparatus of claim 37, wherein the first and second side portions are spaced laterally of the adapter member.

39. The apparatus of claim 38, further comprising a support member disposed proximal the front portion and spanning between the first and second side portions, wherein the support member is rigidly connected to the first and second side portions such that substantial downward forced can be transmitted through the support member to the plurality of anchors.

40. The apparatus of claim 37, wherein when the stretcher head assembly is received by the adapter portion, each of the first and second side portions is disposed laterally of the stretcher head assembly.

41. The apparatus of claim 37, wherein at least a portion of an anchor is curved.

42. The apparatus of claim 37, further comprising at least one anchor guard adapted to substantially enclose at least a portion of one or more anchors, the anchor guard comprising a moldable plastic material.

43. The apparatus of claim 37, wherein the adapter portion receives the stretcher head assembly at an angled from a horizontal plane defined by the floor when the frame is removably coupled to the floor.

44. The apparatus of claim 43, wherein when the stretcher head assembly is received by the adapter portion, a carpet-engaging head unit of the stretcher head assembly is disposed proximal the front portion and elevated from the horizontal plane such that, when the head unit is forced downward to engage a web of carpet, a moment is created about the frame member that compels the anchors toward the floor.

45. The apparatus of claim 37, wherein at least one of the anchors has a tip portion to penetrate a web of carpet upon application of a downward force by a user.

46. The apparatus of claim 37, wherein the stretcher head assembly is received by the adapter portion.

47. The apparatus of claim 37, wherein the first and second side portions are each rigid and unhinged.

48. The apparatus of claim 37, wherein all of the plurality of curved anchors are disposed forward of the head unit.

* * * * *